US005371961A

United States Patent [19]

Mattesky

[11] Patent Number: 5,371,961

[45] Date of Patent: Dec. 13, 1994

[54] PAD AND SHEET TACKING IN IRONING BOARD COVER

[75] Inventor: Henry Mattesky, Cedar Grove, N.J.

[73] Assignee: Herbert Glatt, Morristown, N.J.

[21] Appl. No.: 939,930

[22] Filed: Sep. 2, 1992

[51] Int. Cl.[5] ..... D06F 83/00

[52] U.S. Cl. ..... 38/140

[58] Field of Search ..... 38/66, 103, 104, 140; 156/93, 66, 70, 91, 291, 295, 308.4; 223/51

[56] References Cited

U.S. PATENT DOCUMENTS

| | | | |
|---|---|---|---|
| 1,146,349 | 7/1915 | Ross | 38/140 |
| 1,636,913 | 7/1927 | Kobrin | 38/140 |
| 2,030,135 | 2/1936 | Carpenter | 38/140 |
| 2,291,764 | 8/1942 | Schulz | 38/140 |
| 2,382,830 | 8/1945 | Sunbury | 38/66 |
| 3,007,267 | 11/1961 | Goldsmith | 38/140 |
| 3,603,011 | 1/1971 | Cohen | 38/140 X |
| 3,911,603 | 10/1975 | Lehrman | 38/140 |
| 4,360,984 | 11/1982 | Ruttenberg | 38/140 |
| 4,557,062 | 12/1985 | Mattesky | 38/140 |
| 4,813,166 | 3/1989 | Drake | 38/140 |

FOREIGN PATENT DOCUMENTS

| | | | |
|---|---|---|---|
| 0454763 | 3/1949 | Canada | 38/140 |
| 0180556 | 5/1986 | European Pat. Off. | 38/140 |
| 3433170 | 3/1986 | Germany | 38/140 |

*Primary Examiner*—Clifford D. Crowder
*Assistant Examiner*—Ismael Izaguirre
*Attorney, Agent, or Firm*—Omri M. Behr; Matthew J. McDonald

[57] ABSTRACT

A cover for an ironing board has a sheet and a stretchable pad. The sheet has a front nose, a back and an underside and is shaped to cover the ironing board. This sheet has a marginal draw string for marginally securing the sheet to the ironing board. The stretchable pad has a shape complimenting the sheet. This pad is tacked to the underside of the sheet at a pair of spaced locations at the front nose and the back to partially allow the pad to slide relative to the sheet. Thus the pad can settle wrinkle-free on the ironing board with a degree of independence from the cover, and without a full barrier between the sheet and the pad.

14 Claims, 1 Drawing Sheet

PAD AND SHEET TACKING IN IRONING BOARD COVER

BACKGROUND OF THE INVENTION

1. Field of the Invention

The present invention relates to ironing board covers, and in particular, to covers having a pad underlying a sheet.

2. Description of the Related Art Including Information Disclosed Under 37 CFR 1.97–1.99.

Known ironing board covers employ a heat resistant fabric matching the shape of the ironing board. The sheet is sufficiently oversized to allow its margins to fold around and under the board. A draw string on the margin of the cover can be drawn to secure the cover to the board. In some embodiments, the cover has a foam pad underneath the sheet.

When a garment is being ironed it is desirable to have steam pass freely through the garment and the cover on the ironing board and into the underlying pad. This free passage promotes generous circulation of steam, which facilitates ironing.

In U.S. Pat. No. 3,911,603 a foam pad is adhesively secured to the underside of a fabric cover for an ironing board. The foam is glued essentially along the entire interface between the cover sheet and the pad. A disadvantage with this cover is the fact that a glue barrier exists between the pad and the top sheet, which impedes the circulation of steam.

Another disadvantage with this known ironing board cover is the fact that the joint between the top sheet and the foam pad must be set precisely so that wrinkles are not fixed in either the pad or the upper sheet. Also, the extensive adhesive layer makes the cover stiff. Consequently, if the product is folded for shipment, creases form that are not easily removed when the product is unfolded and installed on an ironing board.

Accordingly, there is a need for an improved ironing board cover that lies wrinkle-free and does not have a barrier to prevent steam circulation through the garment and into the cover.

SUMMARY OF THE INVENTION

In accordance with the illustrative embodiments demonstrating features and advantages of the present invention, there is provided a cover for covering an ironing board. The cover has a sheet and a stretchable pad. The sheet has a front nose, a back and an underside and is shaped to cover the ironing board. The sheet has a marginal means for marginally securing the sheet to the ironing board. The stretchable pad has a shape complimenting the sheet. This pad is tacked to the underside of the sheet at a pair of spaced locations at the nose and the back to partially allow the pad to slide relative to the sheet. Thus, the pad can settle wrinkle-free on the ironing board with a degree of independence from the cover and without a full barrier between the sheet and the pad.

By employing such apparatus an improved ironing board cover is achieved. In a preferred embodiment, a fabric with a heat resistant coating is tacked to a polyurethane foam pad. Preferably, the pad is adhesively bonded to the fabric at its nose and back. The adhesive regions may be narrow regions running transverse to the length of the pad and the fabric.

In this preferred embodiment, the length of the fabric sheet between the two adhesive regions exceeds the length of the pad between those same regions, before stretching of the pad. Preferably, the top sheet is effectively 0.5% to 3% longer than the pad between the adhesive regions. Accordingly, the cover can be installed by pulling the top sheet over an ironing board and possibly securing it with a marginal draw string. This installation stretches the underlying pad so it lies wrinkle-free and without an extensive adhesive barrier that would prevent circulation of steam through the garment being ironed and into the cover pad.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings wherein.

BRIEF DESCRIPTION OF THE PREFERRED EMBODIMENTS

Referring to FIGS. 1–4, in ironing board 10 is shown having an upper surface that is generally rectangular, but has a blunt, tapered front nose. Board 10 may be any one of various conventional boards, and does not form a part of this invention.

A cover for board 10 is shown employing an upper sheet 12 and a stretchable pad 14. Sheet 12 is made of a fabric such a cotton coated with a heat resistant material. Sheet 12 may use materials and coatings that are conventional and used commercially. In some embodiments, fabrics other than cotton may be employed and porous sheets and sheets woven from synthetic fibers may be used as well. It is preferred that the sheet have the ability to allow the passage of steam.

Figure 1:
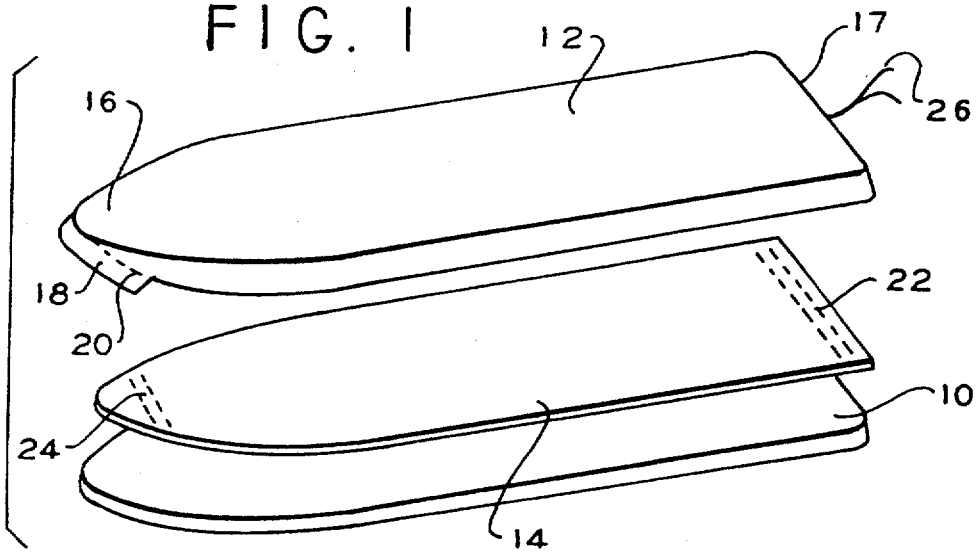
FIG. 1 is an exploded, perspective view of a cover and ironing board in accordance with the principles of the present invention.
Figure 3:
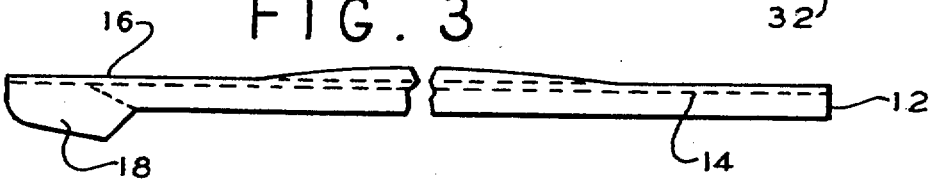
FIG. 3 is a side view of the cover of FIG. 1 with the pad underlying the upper sheet.

Stitched along seam 20 on the nose 16 of sheet 12 is a crescent-shaped flap 18 forming a pocket. This pocket is sized to slip over the nose of board 10. As shown in FIGS. 1 and 3, seam 20 runs near but not exactly along the edge of the board 10 when the cover is installed.

Pad 14 is a polyurethane foam sheet approximately $\frac{3}{8}$ inch (0.95 cm) thick although other porous materials can be employed instead. Pad 14 may be 54 inches (137 cm) long and 15 $\frac{1}{4}$ inches (38.7 cm) wide, although these dimensions will vary depending upon the size of the board that is to be covered. Pad 14 is adhesively secured to the underside of sheet 12 along an adhesive region 22 at the back of pad 14 and an adhesive region 24 at the nose of the pad. The adhesive may be applied in the pattern indicated, either atop pad 14, under sheet 12, or in both locations. The adhesive may be any one of a number of adhesives designed to bind a fabric to a foam.

The adhesive will be chosen depending upon the nature of the materials in the pad and the sheet. Examples of adhesives include resin based adhesives, epoxies, various contact cements etc. In any event, the adhesive will be chosen to form a strong, heat resistant bond without degrading the materials of the sheet and pad.

While adhesive strips 22 and 24 (and their counterparts on the underside of the sheet 12) are shown as spaced locations in the form of strips transverse to the length of the pad and sheet, they may be shaped otherwise. For example in some embodiments, the pad and sheet may be tacked at 4 points: a pair of tacked points at opposite sides near the back, and two tacked points on opposite sides of the nose. The pad having between the separate and distinct nose and back locations a region extending the entire width of the pad without connection to the sheet.

Alternatively, the pad and a sheet can be bonded by stitching, stapling, riveting, or other appropriate fastening means. It is desirable however, that the tacking of the pad to the cover does not create an extensive barrier between the top sheet 12 and pad 14. It is also preferred that the stitching, riveting or other fastening means be of relatively small dimensions so as not to interfere with the ironing.

The tacking between pad 14 and top sheet 12 is such that the unstretched length of pad between regions 22 and 24 is less than the corresponding length on top sheet 12. This difference can be between 0.1% to 4%, but preferably is between 0.5% to 3%. For example, for a 54 inch (137 cm) ironing board the difference in length will be about ¼ to 1½ inches (0.63 to 3.8 cm). The difference can be achieved by either securing pad 14 on a fixture that stretches pad 14 the desired amount. Thereafter the sheet 12 can be attached by applying an adhesive to pad 14, sheet 12, or both. Alternatively, the back (or the nose) of the pad can be secured to the sheet 12. Then a predetermined amount of slack can be induced into the sheet 12 by forming a standard wrinkle either manually or with a clip that is part of the fixture. Thereafter the adhesive bonding can be completed. As shown in FIG. 3, before installing the finished product, a clearance exists between pad 14 and the underside of sheet 12.

Figure 4:
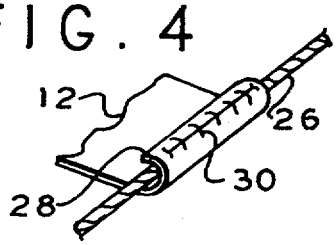
FIG. 4 is a detailed perspective view of a fragment of a marginal means employed in the cover of FIG. 1.
Figure 2:
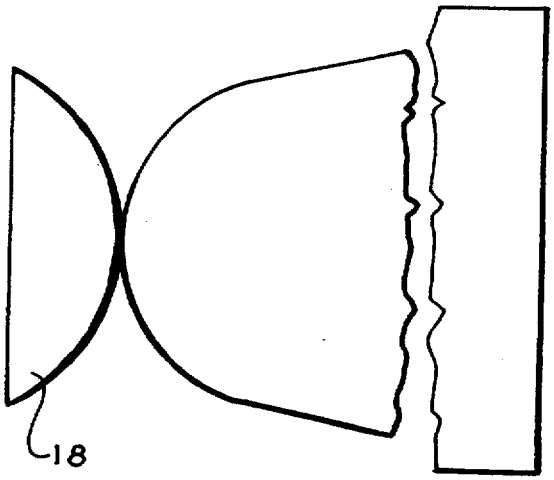
FIG. 2 is a development showing illustrating the pocket arrangement in the front nose of the cover of FIG. 1.
Figure 5A:
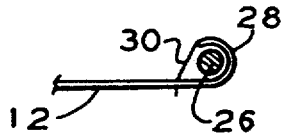
FIG. 5A is cross-sectional view of the marginal means of FIG. 4.

A marginal means is shown herein as a draw string 26 that is secured to the margins of top sheet 12. As shown in FIGS. 4 and 5A, the sheet 12 can be folded to form a sleeve 28 containing draw string 26. In this embodiment stitches 30 hold sleeve 28 in a U-shape and extend from the sleeve edge across the opening of the U-shaped sleeve, thereby enclosing draw string 26.

Figure 5B:
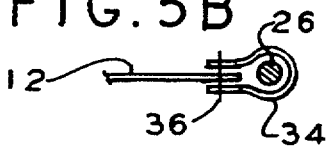
FIGS. 5B and 5C are cross-sectional views of marginal means that are alternates to that of FIG. 4.
Figure 5C:
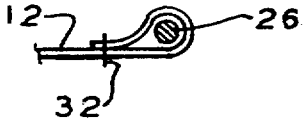

In the alternate embodiment shown in FIG. 5C, sheet 12 folds on itself and is stitched at location 32. In the alternate of FIG. 5B a U-shaped fabric sleeve 34 or binding straddles the margin of sheet 12 to encompass draw string 26. The sleeve 34 is stitched at location 36 in the embodiment of FIG. 5C.

Other means can be used to secure the cover to the ironing board. The use of elastic binding, ironing board fasteners, Velcro(TM) straps and other methods can be used. Any fastening method which enables the pad to stretch to the degree described is satisfactory.

To facilitate an understanding of the principles associated with the foregoing apparatus, its operation will be briefly described. The cover comprising pad 14 and top sheet 12 is stretched over board 10. The pocket 18 may be first placed over the nose of board 10 and the back 17 draped over the back of board 10. Thereafter, draw string 26 may be pulled to draw the margin of sheet 12 tightly under board 10. When the sheet 12 is tautly installed, pad 14 is stretched as a result. Pad 14 is stretched 0.5% to 3%, depending upon the predetermined stretch designed into the cover. Consequently, both sheet 12 and the pad 14 are installed without wrinkles. Wrinkles are unlikely in pad 14 since it is not bonded along the length of cover 12. Thus pad 14 is free to follow its own path without the inducement of wrinkles from sheet 12.

Once the cover is thus installed, a user can iron in the usual fashion. Because there is no pervasive adhesive or other barrier between sheet 12 and pad 14, steam from an iron can pass through the sheet 12 and freely disperse within pad 14.

Obviously, many modifications and variations of the present invention are possible in light of the above teachings. It is therefore to be understood that within the scope of the appended claims, the invention may be practiced otherwise than as specifically described.

I claim:

1. A cover for covering an ironing board, comprising:

a sheet having a front nose, a back and an underside, and being shaped to cover the ironing board, said sheet having a marginal means for marginally securing said sheet said ironing board; and pair of spaced locations, said pad having between said separate and distinct locations a region extending the entire width of said pad without connection to said sheet, said underside of said sheet being contiguous to said topside of said pad between said pair of spaced locations.

a stretchable pad having a topside and a shape similar to said sheet, the topside of said pad being tacked to the underside of said sheet at a pair of spaced, separate and distinct locations, one at said front nose and another one at said back, to allow said pad along its entire width and a portion of its length between said pair of spaced locations to slide relatively to and independently of said sheet and to avoid folds or wrinkles on said ironing board between said pair of spaced locations, said pad having between said separate and distinct locations a region extending the entire width of said pad without connection to said sheet, said underside of said sheet being contiguous to said topside of said pad between said pair of spaced locations.

2. A cover according to claim 1 wherein said sheet has a first predetermined distance measured on said sheet between said pair of spaced locations, said pad having a second predetermined distance measured on said pad between said pair of spaced locations, said first predetermined distance exceeding said second predetermined distance.

3. A cover according to claim 2 wherein the first predetermined distance exceeds said second predetermined distance by at least 0.05%.

4. A cover according to claim 3 wherein the first predetermined distance exceeds said second predetermined distance by no more than 3%.

5. A cover according to claim 4 wherein said pad and said sheet are adhesively tacked.

6. A cover according to claim 4 wherein said pad and said sheet are tacked by stitching.

7. A cover according to claim 4 wherein said pad is porous.

8. A cover according to claim 2 wherein said pad and said sheet are adhesively tacked and have a longitudinal axis, and wherein said pair of spaced locations are each narrow adhesive regions running transversely to the longitudinal axis of said pad and said cover.

9. A cover according to claim 8 wherein said marginal means comprises:

a draw string slidably secured to the margin of said sheet.

10. A cover according to claim 9 wherein said margin of said sheet is folded and secured to form a sleeve for containing said draw string.

11. A cover according to claim 10 wherein said cover has a pocket formed at said front nose for encompassing part of said ironing board.

12. A cover according to claim 11 wherein said sheet comprises a fabric having an outer, heat-resistant coating.

13. A cover according to claim 12 wherein the length of said sheet between said pair of spaced locations exceeds that of said pad by at least 0.05%.

14. A cover according to claim 13 wherein the length of said sheet between said pair of spaced locations exceeds that of said pad by no more than 3%.

* * * * *

UNITED STATES PATENT AND TRADEMARK OFFICE

CERTIFICATE OF CORRECTION

PATENT NO. : 5,371,961

DATED : December 13, 1994

INVENTOR(S) : Henry Mattesky

It is certified that error appears in the above-indentified patent and that said Letters Patent is hereby corrected as shown below:

In Column 4, line 26, Claim 1, following the word "sheet", add --to--.

In Column 4, line 26, Claim 1, delete "pair of spaced locations, said pad having between said separate and distinct locations a region extending the entire width of said pad without connection to said sheet, said underside of said sheet being contiguous to said topside of said pad between said pair of spaced locations."

Signed and Sealed this

Twenty-fifth Day of April, 1995

*Attest:*

Bruce Lehman

BRUCE LEHMAN

*Attesting Officer*

*Commissioner of Patents and Trademarks*